US005175978A

United States Patent [19]

Knauf

[11] Patent Number: 5,175,978

[45] Date of Patent: Jan. 5, 1993

[54] METHOD FOR WRAPPING PRODUCTS IN VERY LOW CONTACT PRESSURE APPLICATIONS

[75] Inventor: Gary H. Knauf, Appleton, Wis.

[73] Assignee: International Paper Company, Purchase, N.Y.

[21] Appl. No.: 806,003

[22] Filed: Dec. 9, 1991

[51] Int. Cl.[5] ..... B65B 51/10; B65B 23/00; B65B 25/14

[52] U.S. Cl. ..... 53/463; 53/411; 156/320

[58] Field of Search ..... 53/449, 461, 463, 212, 53/216, 375.9, 411; 156/310, 320, 322

[56] References Cited

U.S. PATENT DOCUMENTS

| | | | |
|---|---|---|---|
| 1,953,097 | 4/1934 | Becker | 53/463 |
| 2,167,634 | 8/1939 | Calvert | 53/463 X |
| 2,524,945 | 10/1950 | Von Hofe | 156/320 |
| 2,690,633 | 10/1954 | Denton | 53/463 X |
| 2,828,237 | 3/1958 | Rosser | 154/139 |
| 2,999,782 | 9/1961 | Justice et al. | 154/136 |
| 3,033,707 | 5/1962 | Lacy et al. | 117/76 |
| 3,140,196 | 7/1964 | Lacy et al. | 117/75 |
| 3,230,135 | 1/1966 | Hurst | 161/250 |
| 3,784,434 | 1/1974 | Paisley et al. | 156/280 |
| 3,850,725 | 11/1974 | Spielau et al. | 156/320 X |
| 4,020,215 | 4/1977 | Michaylov | 428/420 |
| 4,302,272 | 11/1981 | Phillips et al. | 156/320 X |

*Primary Examiner*—Horace M. Culver
*Attorney, Agent, or Firm*—Luedeka, Hodges, Neely & Graham

[57] ABSTRACT

A wrapper paper for pressure sensitive products bearing on one of its flat surfaces a layer of polyethylene and on the opposite of its flat surfaces a layer of a primer selected from the polyalkyleneimine class, at least portions of the opposite flat coated surfaces facing one another in overlapping relationship when the paper is wrapped about a product, the overlying areas of the wrapper paper being sealed to one another by heat means and the application of very low pressure to the overlapping portions.

3 Claims, 4 Drawing Sheets

METHOD FOR WRAPPING PRODUCTS IN VERY LOW CONTACT PRESSURE APPLICATIONS

This invention relates to wrapper papers for pressure sensitive products, such as the paper employed in the wrapping for storage and shipping of ream quantities of carbonless printing papers, and to methods for wrapping products employing very low contact pressure in effecting the sealing of the wrapper about the product.

Carbonless printing paper (NCR) and like products most commonly are packaged for shipping and storage in ream quantities, i.e., 500 sheets. Each ream of sheets is overwrapped with a paper-based wrapper to encapsulate the ream of sheets in a tubular shaped overwrap. Thereafter, the opposite ends of the tubular overwrap are folded against the ends of the stack of NCR sheets and the folded ends are sealed in place to complete the package. Either simultaneously with the formation of the end seals, or in a separate operation, those overlapping side edges of the wrapper paper which extend along the length (or width) of the product must also be sealed to ensure proper encapsulation of the product within the wrapper. This seal may be referred to as the longitudinal seal, as opposed to the end seals, and will extend between the end seals of the product.

Printing papers such as NCR paper function best when they are at selected low moisture content. Wrapper papers as described not only serve to protect the wrapped product from physical damage, but also must serve as moisture barriers for protecting the wrapped product against moisture pickup or loss during storage and shipping. Heretofore, it has been the practice to employ paper wrappers which carry a coating of low density polyethylene (LDPE) on one surface thereof. In forming longitudinal and end seals, portions of the polyethylene-coated paper surface will be in contact with the non-coated side of the wrapper paper. By the application of high heat and high pressure, the LDPE may be caused to soften to the point that it will bond with the underlying paper surface to effect a seal of the overfolded portions of the paper wrapper. This prior art procedure suffers from the problem that in effecting the seal(s), the degree of heating and pressing together of the overlying areas of the wrapper paper required to complete the seal also tends to cause the polyethylene that is contiguous to the wrapped product to become bonded to the product. Further when wrapping NCR and like pressure-sensitive products using the prior art procedures, these products are commonly damaged by the high pressures and/or heat required in making these seals.

One alternative to the LDPE seals of the prior art is to substitute a hot melt adhesive for the polyethylene. However, whether this hot melt adhesive is applied as a coating over the entire surface of the wrapper paper or applied as strips between and along the areas sought to be sealed, due to the current emphasis on recycling of papers, the use of hot melt adhesives is unacceptable in that this class of adhesives is notoriously difficult to process through known recycling equipment and processes.

The application of a layer of LDPE or similar polyolefin coating to a flat surface of a paper base web in a manner which permits the LDPE to function as a barrier against the transfer of moisture through the thickness of the paper web is most commonly accomplished using extrusion coating techniques. Effective bonding of the LDPE to the paper web using extrusion coating techniques requires that the polyethylene be heated typically to above about 600° F. As disclosed in U.S. Pat. No. 3,230,135, issued to Hurst, ("Hurst" patent) which is incorporated herein by reference, in the extrusion of coating polyethylene onto a paper web, essentially no bond occurs between the polyethylene and the paper at 600° F. at the conventional rates of progression of the paper web through the extrusion apparatus. In this patent, it is disclosed that the application of a layer of polyamine, e.g., polyethyleneimine (P.E.I.), to the paper web before the polyethylene is extruded onto the web provides good adhesion while permitting the polyethylene extrusion process to proceed at the conventional rates of production if the temperature of the polyethylene is maintained at about 625° F., the minimum acceptable temperature for obtaining good adhesion being 550° F. The process of this patent, however, requires that the polyamine be disposed between the polyethylene and the base web and more importantly, requires that the temperature of the process be above about 550° F. In U.S. Pat. No. 4,020,215, issued to Michaylov, ("Michaylov" patent) it was recognized that the process disclosed in the Hurst patent was deficient in that the Hurst patent did not provide for adhesion of the polyethylene to the paper at sufficiently low temperatures, e.g. below about 550° F. In the Michaylov patent, it is disclosed that the polyethylene layer may be caused to adequately adhere to the paper web at temperatures as low as about 450° F. if one interposes between the polyethylene layer and the P.E.I. layer a further layer comprising Surlyn. This latter polymer is stated to contain functional groups which react chemically with the imine groups of the polyalkyleneimine layer and thereby effect adhesion of the polyethylene layer to the polyalkyleneimine layer, hence to the paper web at temperatures as low as 450° F. Obviously, the addition of this layer of Surlyn also fails to adequately reduce the temperature for effecting a paper-to-polyethylene bond. This technique introduces increased costs both in raw material and in the equipment required for the deposition of the Surlyn layer, plus all the associated problems attending the addition of the further layer.

Neither of the above-noted patents provide a solution to the problem of sealing the overlapping edges of a wrapper paper, for in this application when the edges of the wrapper are overlapped, one of the polyethylene-carrying surfaces of the wrapper paper will be facing the product. Should this layer of polyethylene be heated to its melting point, upon cooling, the polyethylene, hence the wrapper, will become adhered to the product itself. Subsequent attempts to remove the wrapper to get at the product for use will result in at least damage or partial destruction of the product. Further, when the side margins of the wrapper are overlapped, that surface of the outermost of the overlaying margins of the wrapper which carries a polyethylene layer will be facing the reverse surface of the innermost of the overlaying margins of the wrapper and this innermost surface carries no polyethylene so that even if one uses a polyalkyleneimine to enhance the adherence of the polyethylene layer to one side of a paper web as taught in the prior art, there is nothing on the opposite surface of the paper web available to enhance the formation of a polyethylene to paper seal as is required in the wrapping paper situation.

Even further, the prior art as known to the inventor is devoid of teachings which permit the effectuation of a proper polyethylene to paper seal in a wrapping paper disposed about and encompassing a product wherein the product is sensitive to the application of other than low pressure thereagainst. Thus, even though one can heat a polyethylene layer on a wrapping paper to its melting temperature, as is recognized in the art, there remains the requirement that the overlapping layers sought to be sealed must be urged together with substantial pressure in order to effect the necessary seal. In the instance of NCR papers, for example, the pressure required for forcing a molten polyethylene layered paper into sufficient contact with a paper layer to effect an adequate seal therebetween is also sufficient to crush the ink capsules in the NCR paper and destroy its usefulness.

In accordance with the present invention, the inventor has discovered that very low pressure sealing of a polyethylene-coated wrapper paper in encapsulating relationship about a product may be effected by applying to that surface of the wrapper paper opposite the polyethylene layer, a primer layer of a material selected from the polyalkyleneimine group, particularly polyethyleneimine, and thereafter momentarily subjecting the outermost of overlaid marginal areas of the wrapper paper, while in position about the product, to a temperature of between about 520° F. and about 590° F. for a time period of between about 1 and about 1.5 seconds, and with the application of about 0.04 lb/in$^2$ pressure to the overlaid area sought to be sealed. This method provides for simultaneous heating of the polyalkyleneimine-bearing layer and the adjacent and underlying LDPE layer to the extent that with the application of that amount of pressure exerted by the actual weight of the wrapped product can be sufficient to effect the desired seal. The invention further provides an improved wrapper paper comprising a base paper web of wrapping paper weight, e.g. between about 30 and about 60 lb/3000 ft$^2$, having a thin layer of polyethylene disposed at least on the side margins of one flat surface of the paper web and a thin layer of a polyalkyleneimine disposed on at least the side margins of the opposite flat surface of the paper web.

It is therefore an object of the present invention to provide an improved method for very low pressure heat sealing of wrapping paper about a product.

It is another object of the present invention to provide a method for very low pressure heat sealing of wrapping paper about a product employing polyethylene-coated wrapping paper.

It is another object of the present invention to provide a novel wrapper paper of the polyethylene-coated type.

Further objects and advantages of the present invention will be recognized from the present description and the accompanying figures in which.

Figure 1:
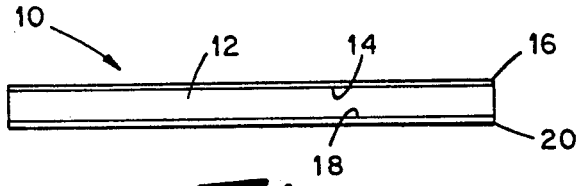
FIG. 1 is a schematic representation of a wrapper paper embodying various of the features of the present invention.

With reference to the several Figures, and particularly initially to FIG. 1, there is depicted a wrapper paper 10 comprising a paper web 12 which serves as the base layer of the wrapper paper of the present invention. On one of the flat surfaces 14 of the wrapper paper 10 there is provided a thin layer 16 of low density polyethylene (LDPE). On the opposite flat surface 18 of the web 12 there is provided a thin layer 20 of a polyalkyleneimine, preferably P.E.I.

Figure 2:
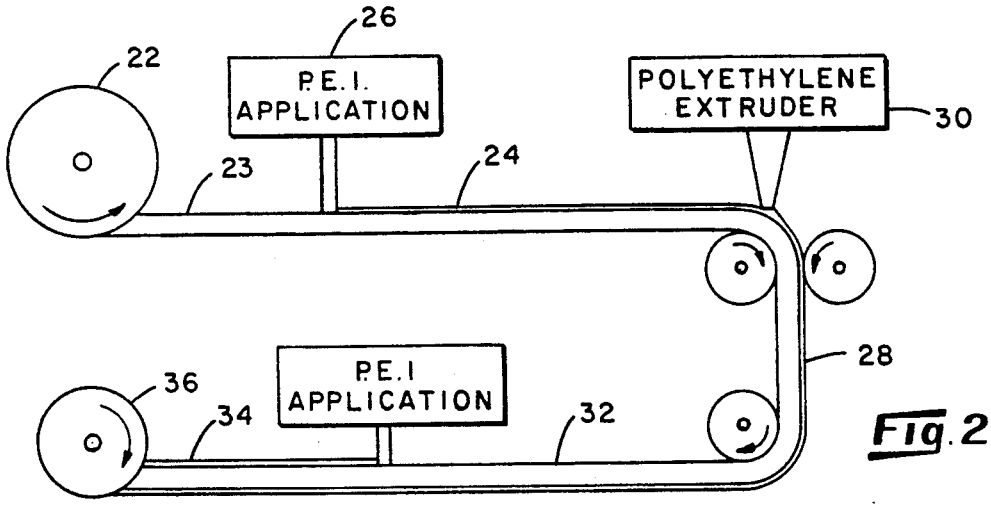
FIG. 2 is a schematic representation of a method for fabrication of the wrapper paper depicted in FIG. 1.

In FIG. 2, there is depicted one embodiment for the manufacture of the wrapper paper depicted in FIG. 1 and includes a supply roll of base paper 22 which is fed forwardly and onto a flat surface 23 thereof there is laid an optional layer 24 of P.E.I. from a conventional P.E.I. applicator 26 followed by extrusion of a layer of polyethylene 28 onto the P.E.I. layer by means of a conventional extruder 30. As desired, the base web may be printed, e.g. labeling, prior to application of the P.E.I. coating. As depicted, as the web is fed forwardly through the process, there is deposited on that surface 32 thereof opposite the polyethylene-carrying surface 23, a layer 34 of a polyalkyleneimine. The bifacial product wrapper paper is collected, as in a roll 36, for subsequent use. Conventionally, the wrapper paper is withdrawn from the roll, slit and sheeted for use in wrapping individual quantities of a product. For example, a wrapper paper for 8.5" by 11.5" printing paper, stacked in reams of 500 sheets, commonly will measure about 22.5" in length (encircles the 8.5" dimension of the ream of papers) by about 14.25" (11.25" plus opposite end flaps) in width. Optionally, the P.E.I. layer may be applied to the paper web prior to application of the LDPE layer to the web. Also, whereas LDPE is the preferred form of polyethylene used with the present web, high density polyethylene (HDPE) may be substituted for the LDPE.

Figure 3:
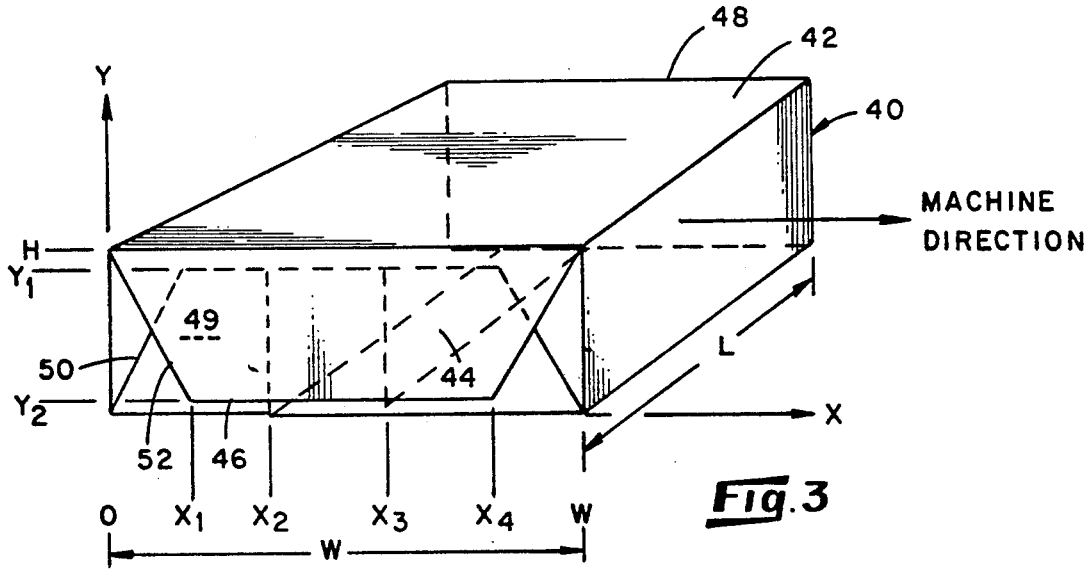
FIG. 3 is a representation of a wrapped package of carbonless printing paper and depicting various of the features of a seal effected in accordance with the present invention.
Figure 4:
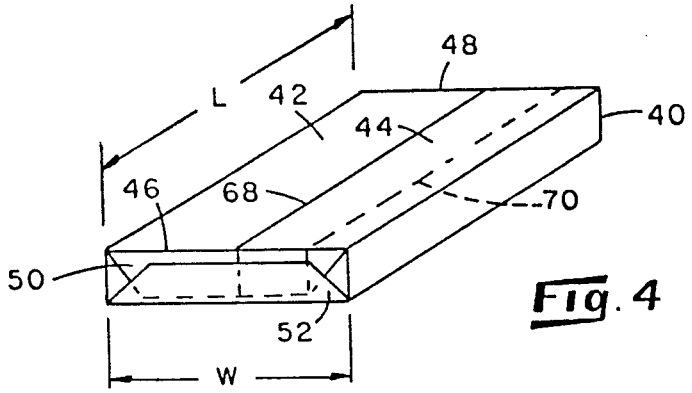
FIG. 4 is a representation of the reverse side of the wrapped package depicted in FIG. 3

In FIGS. 3 and 4 there is depicted a ream of printing papers 40 of the common 8.5"×11" size which has been wrapped with a wrapping paper 42 of the present invention and employing the method of the present invention. The dimensions of the depicted wrapped product are given in Table I where it will be seen that the longitudinal seal 44 extends between the opposite ends 46 and 48 of the product and has a width of about 2.125". The sealing area 49 for each of the overlapping end flaps 50 and 52 on each end of the package is approximately 5.65"×1.065".

TABLE I

| DIMENSIONS OF PRODUCT DEPICTED IN FIGS. 3 AND 4 8-½" × 11" | |
|---|---|
| $x_1$ = | 1 ½" |
| $x_2$ = | 2 ⅜" |
| $x_3$ = | 4 ¾" |
| $x_4$ = | 7 ⅛" |
| W = | 8 ¾" |
| $y_1$ = | 5/16" |
| $y_2$ = | 1 ⅜" |
| H = | 1 11/16" |
| L = | 11 ½" |

TABLE I-continued

| DIMENSIONS OF PRODUCT DEPICTED IN FIGS. 3 AND 4 8-½" × 11" | |
|---|---|
| W × L = | 100.6 in2 |
| Weight = | 4.01 lbs. |
| lb./in$^2$ = | 0.04 psi downward seal pressure |

Figure 5:
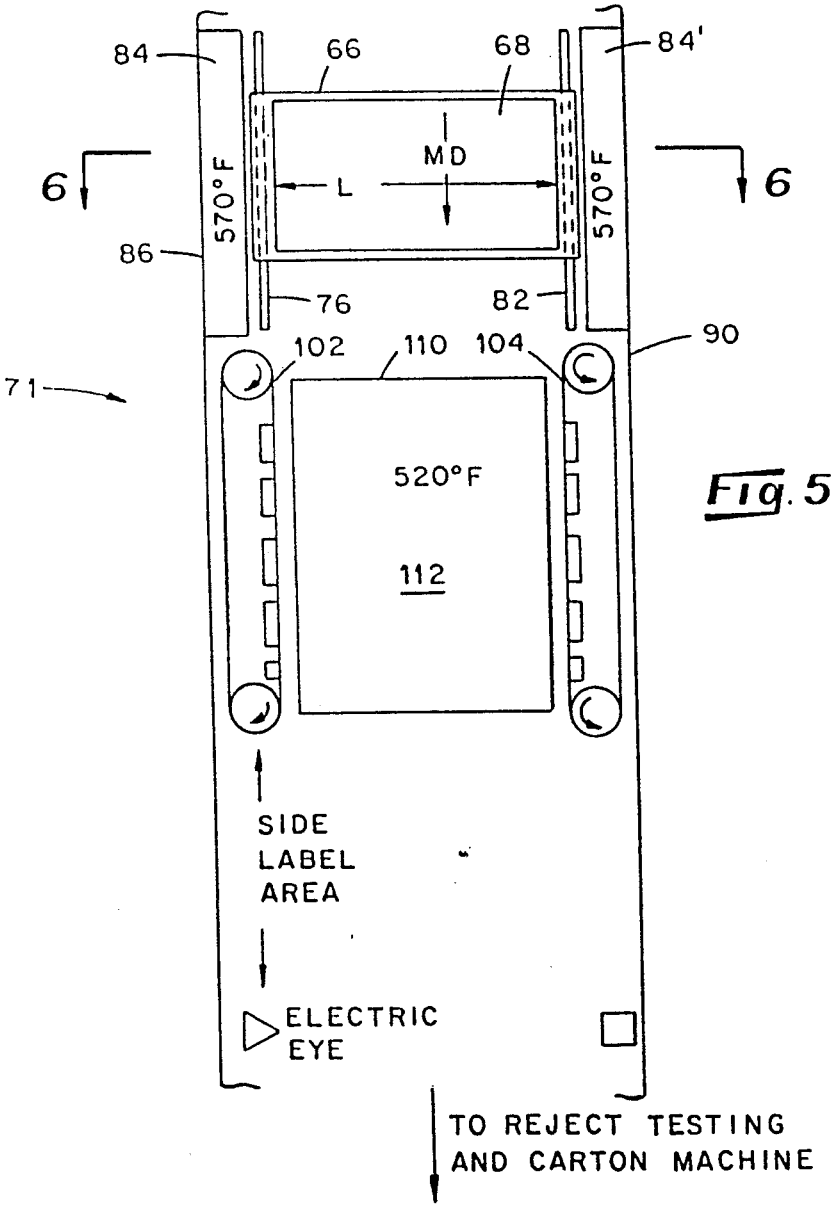
FIG. 5 is a schematic representation (top view) of a system for applying a wrapping paper about a ream of carbonless printing paper and depicting various of the features of the present invention.
Figure 6:
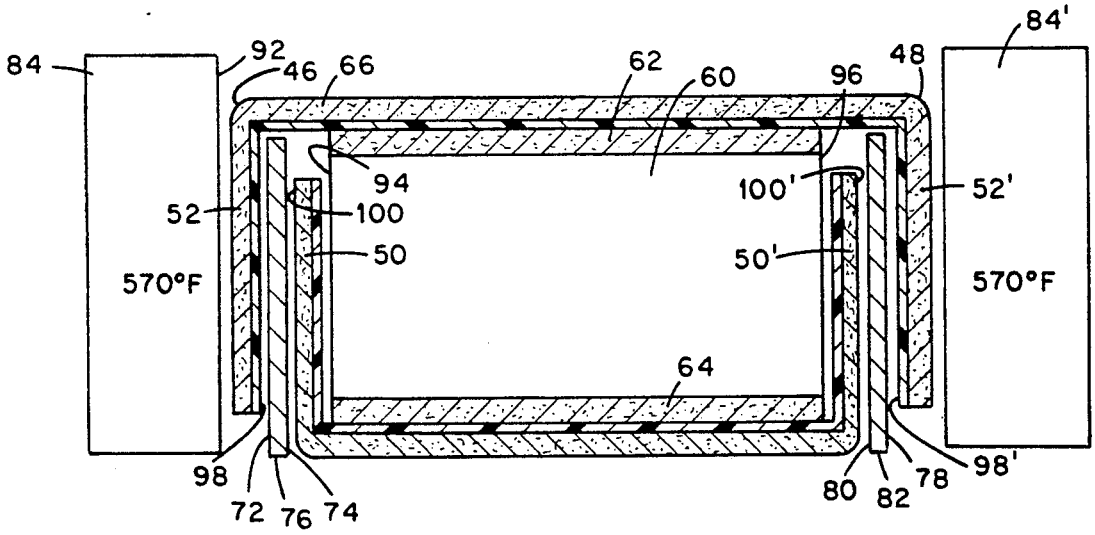
FIG. 6 is a sectional view taken along the line 6—6 of FIG. 3.

One embodiment of a system for sealing a wrapper paper about a product employing various of the features of the present invention is depicted in FIGS. 5 and 6. In these Figures, the product to be wrapped, in this instance a ream of sheets of NCR printing papers 60, is provided with a conventional chipboard 62 and 64 on the top and bottom, respectively of the stack of NCR paper (See FIG. 6). As will appear more fully hereinafter these chipboards serve, among other things, as heat insulators and to prevent the adhesion of the wrapper paper to the NCR paper. One suitable chipboard comprises a cellulosic sheet of about 325 lb/3000 ft$^2$ basis weight. The stack of NCR papers and the chipboards are overwrapped with a sheet of wrapper paper 66 of the type disclosed herein to cause the wrapper paper to encircle the length dimension, L, of the ream of papers and cause the opposite side margins 68 and 70 (See FIG. 4) of the wrapper paper to overlap in an area 44 that extends along the approximate centerline, i.e. midway between the opposite ends 46 and 48 of the ream, and parallel to the length dimension of the ream. This "prewrapping operation" is not depicted but is accomplished by procedures well known in the art.

In the depicted apparatus, the prewrapped ream of NCR papers 40 is received on a suitable conveyor 71 (depicted schematically) for forward movement through the depicted system. As the ream is moved forwardly, i.e., in the machine direction (MD), the top and bottom end fold sections 52 and 50, respectively, of the wrapper at one end 46 of the ream are disposed on opposite sides 72 and 74 of an upright thin divider bar 76 (See FIG. 6). The top and bottom end fold sections 52' and 50', respectively, of the opposite end 48 of the wrapper are likewise disposed on opposite sides 78 and 80 of a further thin divider bar 82. Each of the divider bars is stationary and oriented with its length dimension substantially parallel to the direction of forward movement of the ream by the conveyor belt so that as the ream is moved forwardly, the several end fold sections slide past their respective divider bars and are maintained separated one from another (at one end) for that period of time during which the end fold sections are moving past the divider bars. After moving past the divider bars, the end fold sections are free to be moved together.

As depicted, the apparatus further includes a first elongated heater bar 84 disposed stationarily to the side 86 of the conveyor 71 and laterally outwardly of the divider bar 76 and with its length dimension oriented substantially parallel to the divider bar 76. The heater bar 84 includes a flat smooth heated surface 92 which is spaced from the outer face 72 of the divider bar 76 and the end fold section 52 is contained therebetween as the ream is moved forwardly by the conveyor and past the heater bar and the divider bar. The spacing between the heater bar and the divider bar is chosen to approximately equal the thickness of the end fold section 52 but not such as materially impedes the sliding passage of the end fold section therebetween. On the opposite side 90 of the conveyor 71 there is provided a second stationary heater bar 84' that is disposed in spaced relationship to its respective divider bar 82 to define a containing passageway for the sliding movement of the end fold section 52' therebetween. As the ream moves past the stationary heater bars and divider bars, the second end fold sections 50 and 50', respectively, are disposed between their respective divider bars 76 and 82 and the opposite ends 94 and 96 of the ream. It is to be noted that the polyethylene-carrying surface 48 of the end fold section 52 of the wrapper paper faces the divider bar 76, whereas the P.E.I.-carrying surface 100 of the end fold section 52 faces the opposite flat surface 74 of the divider bar 76 so that these two surfaces, which are ultimately intended to be sealed one to the other are kept out of contact with one another during that time when the end fold sections are separated by the divider bar.

Each of the heater bars is heated by any suitable means, such as electrical resistance heaters to a temperature which is sufficient to heat the polyethylene layer 98 on the end fold section 52 to at least about 210° F. during that time which elapses while the ream is conveyed past the heater bars. In one embodiment, each heater bar is heated to about 570° F. and held at this temperature as successive reams are conveyed therepast. At a rate of forward movement of the ream in which the end of the ream is exposed to the heat from the heater bar for a time of about 1 second, and employing a wrapper paper having a basis weight of about 60 lb/3000 ft$^2$ and a ⅛" thick divider bar of teflon-coated steel, the polyethylene layer 98 will be heated to the desired temperature. At this temperature, the P.E.I. layer on the surface 100 of the end fold section 50 is also activated. Simultaneously, the end fold sections 50' and 52' are subjected to like heating while maintained separated.

As depicted, following heating of each of the ends of the ream, it is moved forwardly out of engagement with the divider bars (and heater bars) and between a pair of vertically oriented endless belts 102 and 104, one belt being disposed on each of the opposite sides of the conveyor and spaced apart by a distance that is slightly greater than the length dimension of the ream moving therebetween. These belts serve to press the heated end fold sections inwardly toward the ends of the ream and apply sufficient pressure to bring the heated P.E.I.-carrying surfaces 100 and 100' and the polyethylene-carrying surfaces 98 and 98' of the end fold sections 52, 52' and 50, 50' on the opposite ends of the ream into intimate contact with one another as required to effect the sealing together of these overlapping end fold sections. Referring to FIGS. 3 and 4, in the prior art, it has not been possible to obtain proper sealing in the areas of the end seals between $x_1$ and $x_2$ and between $x_3$ and $x_4$, thereby making these areas suspect as respects the leakage of water vapor therepast. Employing the present wrapper paper and method, these same areas, plus the area between $x_2$ and $x_3$ are fully sealed and enhance the water vapor barrier characteristics of the end seals.

With reference to FIG. 5, the depicted apparatus further includes a horizontally oriented bottom heating bar 110 disposed between the opposite sides of the conveyor and having an upper flat heated surface 112 over which the ream slides as the ream is moved forwardly by the conveyor. It will be recognized that the longitudinal sealing area 44 for the wrapper paper extends laterally across the width of the conveyor, i.e. normally to the machine direction of the apparatus, so that as the ream slides over the bottom heating bar 110, this sealing area becomes heated to a temperature sufficient to activate the P.E.I.-carrying surface and its underlying polyethylene-carrying layer of the wrapper paper to a temperature sufficient to activate the P.E.I. and to at least render the polyethylene molten during the time of residence of this sealing area in contact with the bottom heating bar. In one embodiment, the bottom heater bar is maintained at approximately 520° F. so that a residence time of about 1.5 second of the ream in contact with the bottom heater bar has been found appropriate for activating the coated layers of the wrapper paper such that the mere weight of the ream of papers provides sufficient pressure for effecting the required intimate contact between the activated layers to complete the desired longitudinal seal. It has been found that under these described conditions, a pressure of approximately 0.04 psi applied to the activated layers is suitable for effecting the required pressure from bringing the activated layers into intimate contact with one another and effecting the desired seal upon cooling of the contacting layers. The presence of the bottom chipboard 64 disposed under the stack of NCR papers provides protection against the adhesion of the wrapper paper to the papers themselves and further serves as a heat barrier to protect the NCR papers from excessive heating as the ream passes over the bottom heater bar.

In specific examples, various wrapping papers were prepared employing a 50 lb/3000 ft$^2$ base paper web formed of bleached cellulosic kraft (Southern softwood) pulp. This base paper web was coated on one of its opposite flat surfaces with a layer of polyethylene by conventional extrusion techniques. To the opposite flat surface of the base paper web there was applied a layer of P.E.I. The P.E.I. chosen was Polymin P, available from BASF Wyandotte Corp. of Parsippany, N.J. In one set of wrapping papers, the quantity of P.E.I. was selected to be between about 0.5 and about 1.0 lb/3000 ft$^2$ (light coating). In other sets of wrapping papers, the quantity of P.E.I. applied to the base paper web was selected to be between about 1.0 and about 2.0 lb/3000 ft$^2$ (medium coating) and between about 2.0 and about 3.0 lb/3000 ft$^2$ (heavy coating). The quantity and type of LDPE applied to the various sets of wrapper papers is given in Table II below. A like sample of wrapper paper was made employing HDPE.

Wrapper papers from each of these sets was used to wrap individual reams of NCR printing papers employing the apparatus described hereinabove. Thereafter, the seals formed were tested for percent fiber tear when the seals were pulled apart. The results of these tests are presented in graphic form in FIG. 7 and show that with about 9 lb/3000 ft$^2$ of LDPE coating on one surface of the base paper web, there was very little (5%) fiber tear in the sealed area of the wrapper paper, but with the addition of a light layer of P.E.I. on that side of the base paper web opposite the LDPE coating (so that the P.E.I. layer faced the LDPE layer during sealing), the fiber tear increased dramatically to 85%. Other equally dramatic increases in fiber tear, each indicating a more complete seal, are shown in Table II and FIG. 7.

TABLE II

LIQUID PRIMER STUDY - NCR REAM WRAP APPLETON PAPERS (60/40 SOUTHERN SOFTWOOD AND NORTHERN PINE BLEND)

Base Paper: 50# BLCH MG

| SAMPLE PRIMER | COATING | % FIBER ACCEPTABLE ABOVE ABOUT 50% TEAR HEAT SEAL - PAPER TO COATING | | | |
|---|---|---|---|---|---|
| | | NO PRIMER | LIGHT PRIMER | MEDIUM PRIMER | HEAVY |
| 1 | 9# LDPE | 5 | 85 | 75 | 100 |
| 2 | 20# LDPE | 40 | 95 | 90 | 90 |
| 3 | 13# HDPE | 0 | 75 | | |

Figure 7:
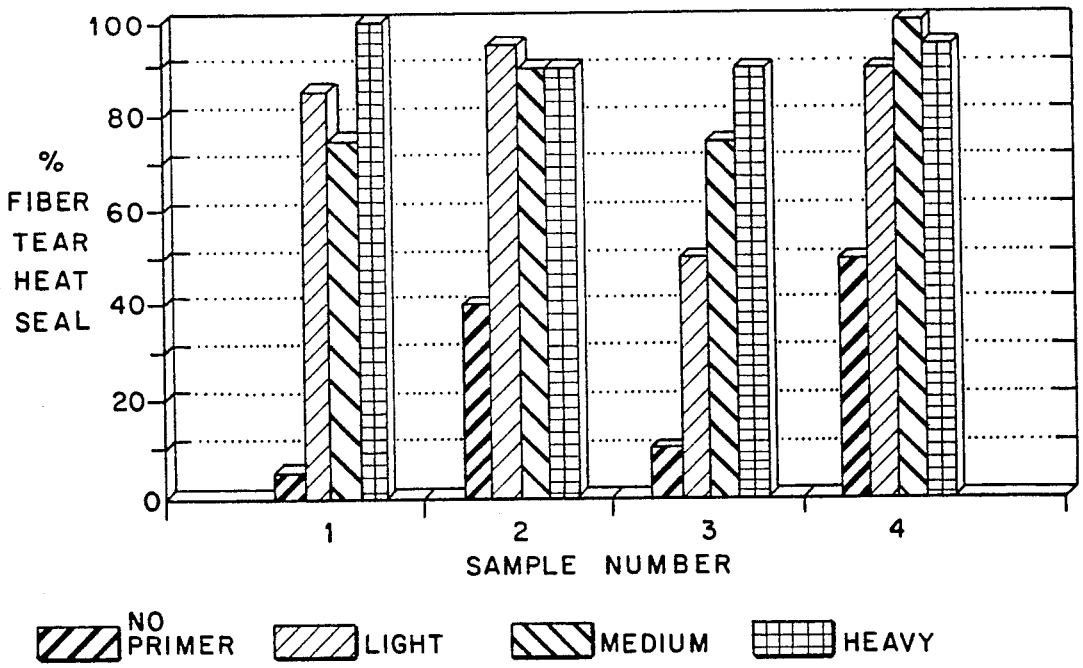
FIG. 7 illustrates in graphic form the results of tests of several sets of wrapper papers according to the invention.

It is further noted from FIG. 7 that increasing the quantity of LDPE from about 10 to about 20 lb/3000 ft$^2$ on the base paper web did not enhance the sealing to an extent sufficient to justify the cost of adding the additional LDPE so that preferably the quantity of LDPE applied to the base paper web is kept at about the 9 lb/3000 ft$^2$ level. At LDPE coating levels below about 9 lb/3000 ft$^2$, the WVTR (water vapor transmission rate) exceeds the maximum acceptable level of about 2.5 gm $H_2O$/100 in$^2$/day. Table III presents the WVTR values of various wrapper papers embodying features of the present invention.

TABLE III

| LDPE wt lb/3000 ft$^2$ | WTVR gm $H_2O$/100 in$^2$ day |
|---|---|
| 8.5 | 2.85 |
| 9.4 | 2.52 |
| 9.7 | 2.49 |
| 9.7 | 2.59 |
| 10.4 | 2.45 |
| 14.1 | 1.52 |
| **HDPE wt lb/3000 ft$^2$** | **WVTR gm $H_2O$/100 in$^2$ day** |
| 13.0 | 0.95 |

Various modifications of the present product and method will be obvious to one skilled in the art. For example the base paper web may be formed of any of several different types of pulp. Preferably, however, the basis weight of the base paper web is selected to be between about 30 and 60 lb/3000 ft$^2$ in that lighter papers do not provide adequate strength and heavier papers are less amenable to folding properly about a product. Whereas polyethyleneimine is the preferred primer, other primers of the polyalkyleneimine class as defined in U.S. Pat. No. 3,230,135 may serve as the primer layer of the present product. Further, preferably the polyethylene and P.E.I. layers are uniformly spread over their respective flat surfaces of the base paper web, but it will be recognized that the P.E.I. layer, at least, may be disposed only in those marginal areas of the wrapper where sealing is desired.

The claims:

1. A method for sealing overlapping edges of a paper wrapper about a stack of pressure sensitive material comprising the steps of overlaying a layer of low density or high density polyethylene on a flat surface of at least a margin of said paper wrapper, overlaying a layer of a primer on a flat surface of at least a margin of said paper wrapper, said primer layer being on that surface of said wrapper paper opposite the surface which carries said polyethylene, positioning said paper wrapper about said stack of pressure sensitive material with said layered margins of said paper wrapper disposed in facing relationship and with the primer layer being juxtaposed to said polyethylene layer, while maintaining said side edges so positioned, subjecting said margins to sufficient heat for a period of time sufficient to activate said primer and melt said polyethylene layer, while said primer is in its activated state and said polyethylene is molten, bringing said overlying margins of said paper wrapper together with said primer layer in contact with said polyethylene layer, and while said first and second layers are in contact with one another, urging said layers into intimate contact with one another with a pressure of a magnitude less than that which is destructive to said pressure sensitive material.

2. The method of claim 1 wherein said layered margins are maintained physically separated until heated.

3. The method of claim 1 wherein said pressure urging said layers into intimate contact with one another is developed primarily by reason of the weight of the product being wrapped.

* * * * *